US006986254B2

(12) United States Patent
Stuttaford et al.

(10) Patent No.: US 6,986,254 B2
(45) Date of Patent: Jan. 17, 2006

(54) METHOD OF OPERATING A FLAMESHEET COMBUSTOR

(75) Inventors: Peter J. Stuttaford, Jupiter, FL (US); Stephen Jennings, Palm City, FL (US); Yan Chen, Palm Beach Gardens, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 9 days.

(21) Appl. No.: 10/437,748

(22) Filed: May 14, 2003

(65) Prior Publication Data

US 2004/0226300 A1 Nov. 18, 2004

(51) Int. Cl.
*F02C 7/228* (2006.01)
*F02C 9/26* (2006.01)

(52) U.S. Cl. ..... 60/773; 60/776; 60/739; 60/39.281; 60/725

(58) Field of Classification Search ..... 60/773, 60/776, 725, 739, 746, 747, 748, 39.281
See application file for complete search history.

(56) References Cited

U.S. PATENT DOCUMENTS

| | | | | |
|---|---|---|---|---|
| 4,112,676 A | | 9/1978 | DeCorso | |
| 4,735,052 A | * | 4/1988 | Maeda et al. | 60/746 |
| 5,121,597 A | * | 6/1992 | Urushidani et al. | 60/778 |
| 5,231,833 A | * | 8/1993 | MacLean et al. | 60/734 |
| 5,319,935 A | | 6/1994 | Toon et al. | |
| 5,321,949 A | * | 6/1994 | Napoli et al. | 60/739 |
| 5,640,851 A | | 6/1997 | Toon et al. | |
| 5,647,215 A | | 7/1997 | Sharifi et al. | |
| 5,983,642 A | | 11/1999 | Parker et al. | |
| 6,209,325 B1 | * | 4/2001 | Alkabie | 60/737 |
| 6,253,555 B1 | | 7/2001 | Willis | |
| 6,345,505 B1 | * | 2/2002 | Green | 60/748 |
| 6,513,334 B2 | | 2/2003 | Varney | |
| 6,532,726 B2 | * | 3/2003 | Norster et al. | 60/748 |
| 6,595,002 B2 | * | 7/2003 | Weisenstein | 60/725 |
| 6,609,376 B2 | * | 8/2003 | Rokke | 60/748 |
| 2002/0020173 A1 | * | 2/2002 | Varney | 60/746 |

OTHER PUBLICATIONS

U.S. Appl. No. 10/424,350, Stuttaford et al.
Richard J. Antos, Westinghouse Combustion Development 1996 Technology Update, Power Generation Combustion Turbine Technology 50 years of Progress Section 8 pp. 2–11.

* cited by examiner

*Primary Examiner*—Ted Kim
(74) *Attorney, Agent, or Firm*—Brian R. Mack

(57) ABSTRACT

A method of operating a gas turbine combustion system having reduced emissions and improved flame stability at multiple load conditions is disclosed. The improved combustion system accomplishes this through complete premixing, a plurality of fuel injector locations, combustor geometry, and precise three dimensional staging between fuel injectors. Axial, radial, and circumferential fuel staging is utilized including fuel injection proximate air swirlers. Furthermore, strong recirculation zones are established proximate the introduction of fuel and air premixture from different stages to the combustion zone. Fuel injection staging sequences are disclosed that create the conditions necessary to provide stable combustion and reduced emissions at multiple load conditions.

6 Claims, 3 Drawing Sheets

METHOD OF OPERATING A FLAMESHEET COMBUSTOR

TECHNICAL FIELD

This invention relates in general to gas turbine combustion systems and specifically to a method of operating a gas turbine combustion system at significantly lower load conditions while having stable combustion and lower emissions.

BACKGROUND

Gas turbine engines typically include a compressor, one or more combustors each having a fuel injection system, and a turbine section. In an engine having a plurality of combustors, they are typically arranged in an annular array about the engine. The compressor pressurizes inlet air, which is then introduced to the combustors, where it is used to cool the combustion chamber as well to provide air for the combustion process. The hot gases resulting from the combustion process are then directed to drive a turbine. For land-based gas turbines whose primary purpose is to generate electricity, a generator is coupled to the turbine shaft such that the turbine drives the generator.

While a full load condition is the most common operating point for land-based gas turbines used for generating electricity, often times electricity demands do not require the full load of the generator, and the operator desires to operate the engine at a lower load setting, such that only the load demanded is produced, thereby saving fuel costs. Combustion systems of the prior art have been known to become unstable at lower load settings while also producing unacceptable levels of carbon monoxide and oxides of nitrogen at lower load settings, especially below 50% load. This is primarily due to the fact that most combustion systems are staged for most efficient operation at high load settings. However, advancements have been made with regards to fuel staging in an effort to lower emissions. For example, U.S. Pat. No. 5,551,228 discloses a method of operating a combustor involving assymetrical fuel staging within a combustor and axially staging fuel injection within a single fuel nozzle for reducing emissions. Furthermore, U.S. Pat. No. 5,924,275 discloses a method of operating a combustor that utilizes the addition of a center pilot nozzle in combination with the previously mentioned assymetrical fuel staging to provide reduced emissions at lower load conditions. While this staging method and combustor configuration is an enhancement, it is still limited in turndown capability, such that in order to achieve turndown to low part-load settings, the combustor often reverts to the higher emissions diffusion mode.

The combination of potentially unstable combustion and higher emissions often times prevents engine operators from running engines at lower load settings, forcing the engines to either run at higher settings, thereby burning additional fuel, or shutting down, and thereby losing valuable revenue that could be generated from the part-load demand. A further problem with shutting down the engine is the additional cycles that are incurred by the engine hardware. A cycle is commonly defined as the engine passing through the normal operating envelope. Engine manufacturers typically rate hardware life in terms of operating hours or equivalent operating cycles. Therefore, incurring additional cycles can reduce hardware life requiring premature repair or replacement at the expense of the engine operator.

What is needed is a system that can provide flame stability and low emissions benefits throughout the full operating conditions of the gas turbine engine, including a low part-load condition, such that engines can be efficiently operated at lower load conditions, thereby eliminating the wasted fuel when high load operation is not demanded or incurring the additional cycles on the engine hardware when shutting down.

SUMMARY AND OBJECTS OF THE INVENTION

The present invention seeks to overcome the shortfalls of the prior art by providing a combustion system that provides stable combustion having low NOx and CO emissions throughout all load conditions. This is accomplished through three dimensional fuel staging, including axial, radial, and circumferential staging such that fuel flow, mixing characteristics, and injection location are precisely controlled depending on the combustor requirements.

In the preferred embodiment of the present invention, the combustion system includes a plurality of injectors staged radially, axially, and circumferentially. The combustor end cover contains a plurality of first injectors arranged in a first array about the end cover and a plurality of second injectors arranged in a second array about the end cover, with the second array radially outward of the first array. A plurality of third injectors are located in a manifold of an aft injector assembly, which is located axially downstream of the end cover and radially outward of the liner. The manifold of the aft injector assembly comprises at least one injection sector providing circumferential fuel staging.

The present invention creates the means by which low emissions stable combustion can occur at various load conditions while remaining in a premix mode at all load conditions. This is accomplished at combustor ignition by supplying fuel to first injectors and a first sector of the aft injector assembly with fuel flow gradually increasing to, the first injectors until crossfire is achieved between adjacent combustors. After crossfire has occurred, fuel flow gradually decreases to the first injectors and first sector of the aft injector assembly until a full engine speed no load condition is reached. At this point, fuel flow to the first sector of the aft injector assembly terminates while fuel flow remains to the first injectors and fuel flow is initiated to the second injectors, gradually increasing to a first part-load condition. Then, fuel flow gradually decreases to both first and second injectors while gradually increasing fuel flow to the first sector of the aft injector assembly. Fuel flow increases to each of these regions to a second part-load condition, at which point fuel flow gradually decreases to first and second injectors and the first sector of aft injector assembly, while initiating and gradually increasing fuel flow to a second sector of the aft injector assembly. From this point, as load increases, fuel flow gradually increases to both first and second injectors and first and second sectors of the aft injector assembly.

It is through precise axial, radial, and circumferential fuel staging described herein that low emissions and stable combustion is maintained throughout all points of the engine operating cycle. By decreasing fuel flow to active injectors when additional injectors are started, emissions levels are controlled. At the first part-load condition, when only first and second injectors are operating, flame temperature will tend to be higher due to the locally high operating fuel/air ratio. As a result, the higher flame temperature precludes the formation of CO while assuring a stable flame at the first part-load condition. Stability is ensured throughout engine load operation by the first injectors supplying fuel preferentially to a shear layer of the combustor.

It is an object of the present invention to provide a method of operating a combustion system having low NOx and CO at multiple operating conditions.

It is a further object of the present invention to provide a method of operating a combustion system having a stable combustion process throughout all operating conditions.

In accordance with these and other objects, which will become apparent hereinafter, the instant invention will now be described with particular reference to the accompanying drawings.

DETAILED DESCRIPTION OF THE PREFERRED EMBODIMENT

Figure 1:
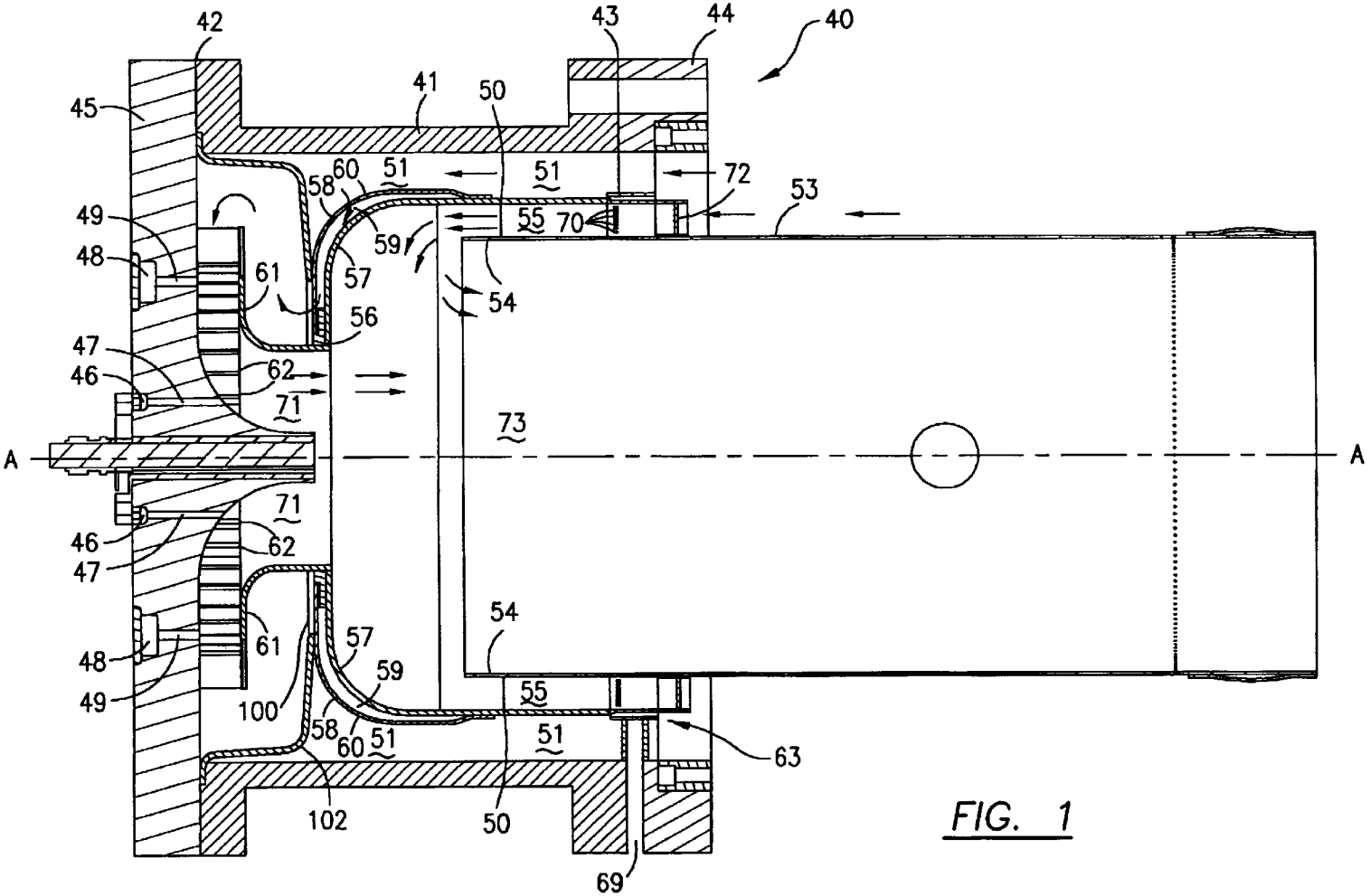
FIG. 1 is a cross section view of the combustor in accordance with the present invention.

Referring to FIG. 1, a gas turbine combustion system 40 in accordance with the present invention is shown. A combustion system 40 is provided, including a casing 41 having a first end 42, a second end 43, and a center axis A—A. Casing 41, which is mounted to an engine through flange 44, is in fluid communication with compressed air from a compressor. An end cover 45 is fixed to casing first end 42, with end cover 45 having at least one fuel source in fluid communication with at least one set of injectors. In the preferred embodiment a first fuel source 46 is in fluid communication with a plurality of first injectors 47, where first injectors 47, comprising at least two injectors, are arranged in a first array radially outward of center axis A—A. Furthermore, the preferred embodiment of end cover 45 also contains a second fuel source 48 in fluid communication with a plurality of second injectors 49, where second injectors 49 are arranged in a second array radially outward of first injectors 47. As with first injectors 47 it is preferred that second injectors 49 comprises at least two injectors.

A dome 50 is located radially inward from casing 41, thereby forming, a first passage 51. Also located radially inward from casing 41 is a liner 53, having a first part 54 located radially inward from dome 50, thereby forming a second passage 55 between dome 50 and first part 54 of liner 53. Dome 50 also contains a first opening 56, an inner dome wall 57, and an outer dome wall 58, where inner dome wall 57 and outer dome wall 58 have a third passage 59 therebetween. An additional feature of dome 50 is the plurality of first feed holes 60 in outer dome wall 58 that extend from third passage 59 to first passage 51.

Figure 2:
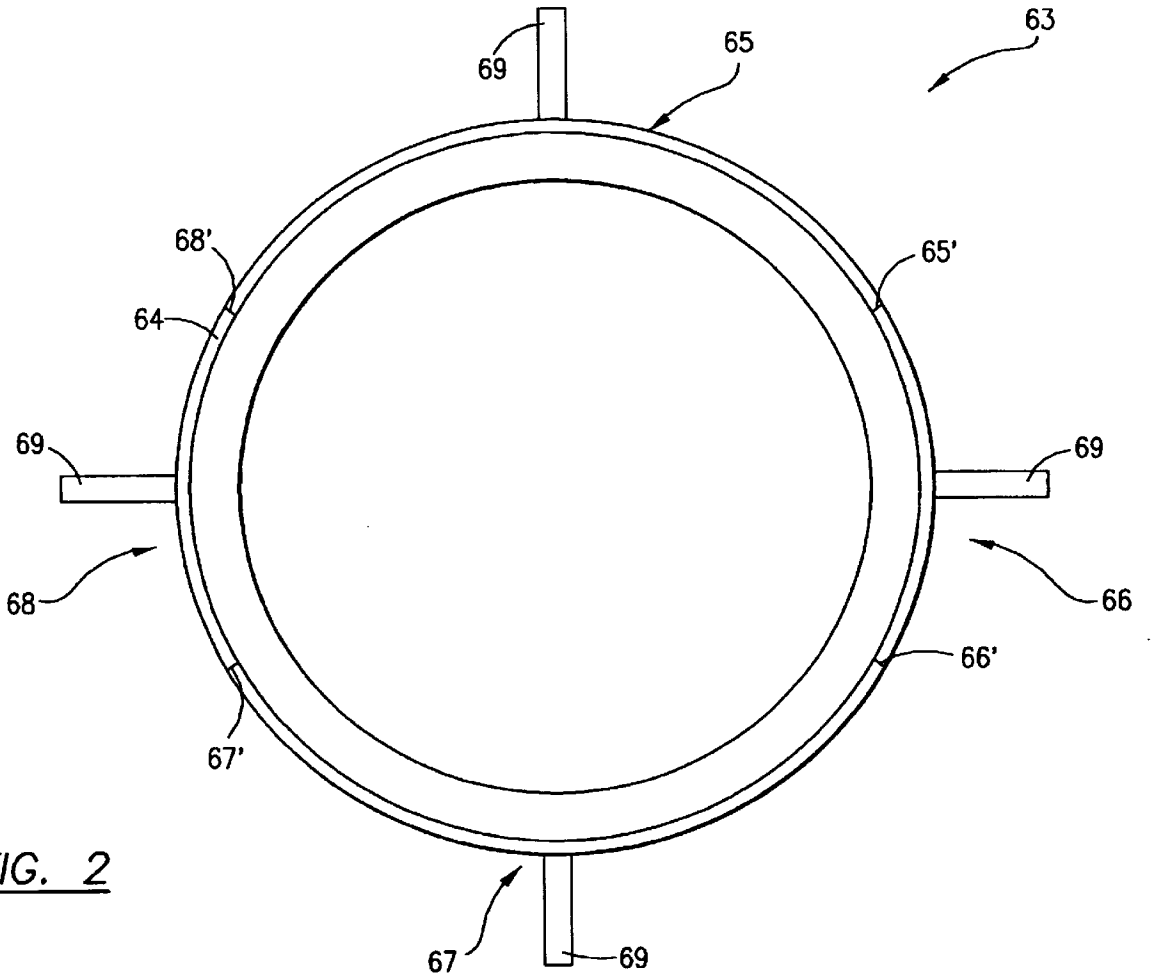
FIG. 2 is a cross section view taken through the aft injector assembly in accordance with the present invention.

The combustion system of the present invention further contains an aft injector assembly 63, which is shown in FIG. 2. Aft injector assembly 63 contains a manifold 64 having at least one region. In the preferred embodiment of the present invention, manifold 64 contains a plurality of regions 65, 66, 67, and 68, with each of the regions in fluid communication with a third fuel source 69. Each of the regions 65, 66, 67, and 68 is isolated from adjacent regions by a manifold wall 65', 66', 67', and 68' so that fuel supplied to one of the regions does not flow into another region of the aft injector assembly 63. Valve means (not shown) permit the fuel flow to each region to be controlled independent of the other regions. Located in manifold 64 is a plurality of third injectors 70 that inject a fuel into second passage 55. Each of the third injectors 70 is connected to only one of the regions 65, 66, 67, or 68, so that all of the fuel that flows through a particular injector 70 during engine operation is supplied by a single region 65, 66, 67, or 68.

Figure 3:
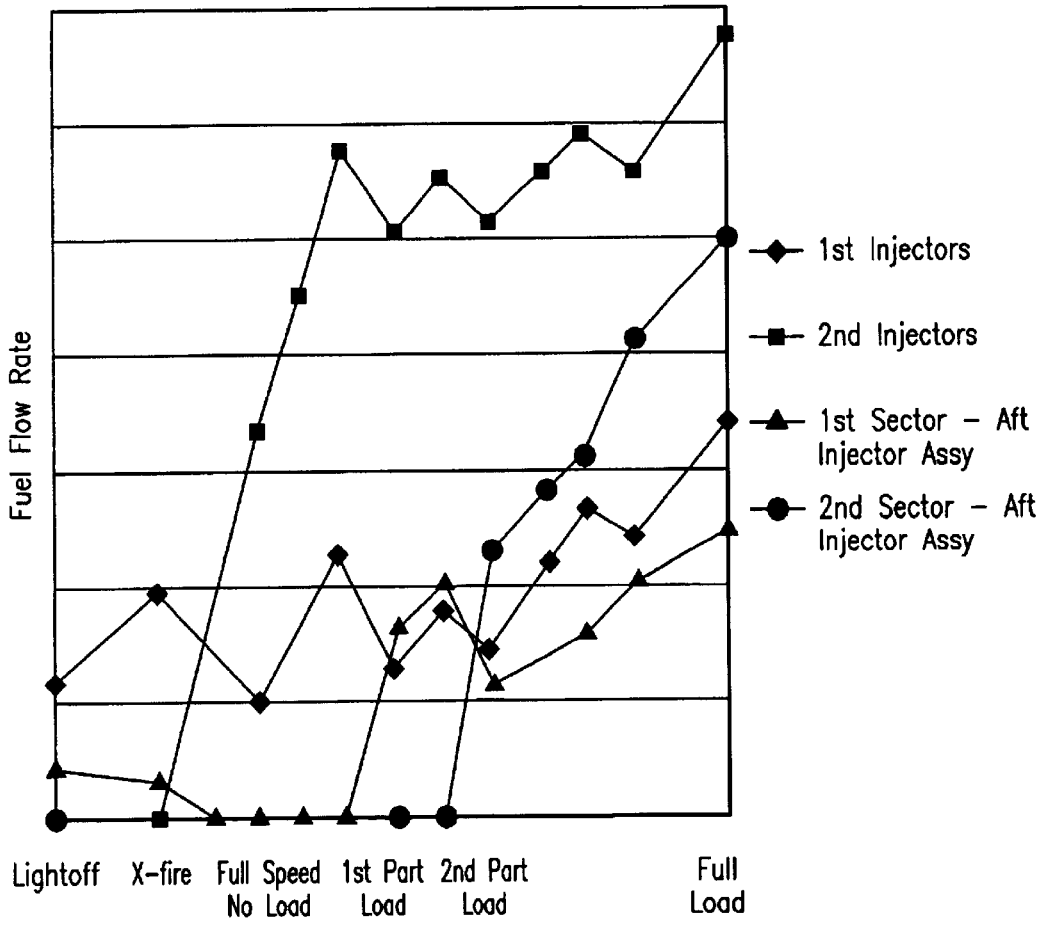
FIG. 3 is a diagram depicting fuel flow rates for each of the fuel injectors as a function of engine condition.

The combustion system of the present invention utilizes premixing fuel and air prior to combustion in combination with precise staging of fuel flow to the combustor to achieve the reduced emissions at multiple operating load conditions. FIG. 3 discloses the method of operating the above described combustion system in order to obtain the reduced emissions. Referring now to FIGS. 1 and 3, compressed air from the engine compressor is flowed in a first direction adjacent liner 53. The compressed air is then split into a first portion and a second portion. First passage 51 between casing 41 and dome 50 receives the first portion of compressed air and directs the air into third passage 59, which is located between inner dome wall 57 and outer dome wall 58, by way of a plurality of first feed holes 60, in order to cool inner dome wall 57. The first portion of compressed air then flows through a second opening 100 in a dome baffle 102, and then enters first swirler 61, passes through passageways 62, and is directed generally radially inward toward center axis A—A, at which point fuel is introduced to the swirling air to form a first mixture. At combustor ignition, fuel is supplied by first injectors 47 and a first sector of aft injector assembly 63. The first mixture from first injectors 47 and first swirler 61 then passes through a fourth passage 71 that directs the first mixture through first opening 56 in dome 50 and into liner 53. A second mixture is formed in second passage 55 from fuel injected by aft injector assembly 63 mixing with a second portion of compressed air. The second portion of compressed air is imparted with a swirl from second swirler 72, located adjacent aft injector assembly 63. In the preferred embodiment, the first sector of aft injector assembly 63 comprises two regions, 66 and 68, which are not adjacent to one another. Regions 66 and 68 that comprise the first sector are positioned adjacent crossfire tubes (not-shown) for supporting the ignition of adjacent combustors. The second mixture passes through second passage 55 and then, due to the geometry of dome 50, turns to flow in a second direction opposite of the first direction and into combustion zone 73. Therefore, fluids in first passage 51 and second passage 55 travel in a direction generally opposite to that of combustion products flowing through liner 53. Fuel flow gradually increases to first injectors 47 until crossfire is achieved between adjacent combustors.

After crossfire has occurred, fuel flow gradually decreases to first injectors 47 and decreases and terminates to the first sector of aft injector assembly 63 while the engine increases in speed. Then, while maintaining fuel flow to first injectors 47, fuel flow is initiated to second injectors 49 until a full speed no load condition is achieved. Next, fuel flow gradually increases to first and second injectors, 47 and 49 respectively, until a first part-load condition is achieved. Then, fuel flow gradually decreases to first and second injectors, 47 and 49, respectively, while fuel flow to the first sector of aft injector assembly 63 is re-established and gradually increases.

As load increases, fuel flow to both first and second injectors, 47 and 49 respectively, and first sector of aft injector assembly 63 increases to a second part-load condition. At this point, fuel flow gradually decreases to first and second injectors, 47 and 49 respectively, and the first sector of aft injector assembly 63, while initiating and gradually increasing fuel flow to a second sector of aft injector assembly 63. In the preferred embodiment, the second sector comprises two non-adjacent regions, 65 and 67, which occupy a majority of aft injector assembly 63, and therefore has a higher fuel flow rate than the first sector. As load increases beyond the second part-load condition to full load, fuel flow gradually increases to first and second injectors, 47 and 49 respectively, and first and second sectors of aft injector assembly 63.

During normal operation the combustor will exhibit a certain level of noise due to the pressure fluctuations, harmonics of the combustor, and effects felt from being in fluid communication with the compressor discharge and turbine. Occasionally these noise levels can become high and if not avoided, they can cause serious damage to the combustion hardware. Engine monitoring apparatus measures, records, and determines if the combustor noise levels become potentially damaging. The present invention provides flexibility in avoiding these high noise levels by allowing for independent adjustment of the fuel stages as necessary to adjust the local heat release and corresponding flame temperature. Typically at least one fuel stage will be adjusted to compensate for the high noise levels. Measuring noise levels and adjusting fuel flow rates between fuel stages continues until the combustor noise levels are returned to an acceptable level.

As previously mentioned, higher flame temperatures minimize the formation of carbon monoxide. The preferred embodiment of the present invention controls NOx and CO emissions levels by precisely staging fuel flow between the axial, radial, and circumferential stages. Specifically, CO emissions at reduced power settings are minimized by adjusting fuel flow to at least first injectors 47, and if necessary, second injectors 49 to minimize the interaction and surface area between fueled and unfueled zones in the combustor. As a result flame temperature increases high enough to assist in CO burn out. The surface area described is in fact the surface area of a shear layer in combustion zone 73 formed between the fuel/air mixture from fourth passage 71 and the fuel/air mixture from second passage 55. Emissions levels are measured and fuel flow is readjusted as necessary to maintain CO emissions at their desired level.

The method of the present invention describes a combustion system operation that can provide flame stability and low emissions benefits throughout the full operating conditions of the gas turbine engine, including a low part-load condition. Therefore, the gas turbine can be operated efficiently at lower load conditions, thereby eliminating wasted fuel when high load operation is not demanded or incurring the additional cycles on the engine hardware when shutting down.

While the invention has been described in what is known as presently the preferred embodiment, it is to be understood that the invention is not to be limited to the disclosed embodiment but, on the contrary, is intended to cover various modifications and equivalent arrangements within the scope of the following claims.

We claim:

1. A method of operating a combustion system of a gas turbine engine, said method comprising:

a) providing a combustion system wherein having a plurality of first injectors arranged in a first array about a center axis, a plurality of second injectors arranged in a second array radially outward of said first injectors proximate a first swirler to mix fuel with a first portion of compressed air, an aft injector assembly comprising a manifold having at least one injection sector and a plurality of third injectors located in said manifold such that fuel mixes with a second portion of compressed air;

b) at ignition, supplying fuel to said first injectors and a first sector of said aft injector assembly with fuel gradually increasing to said first injectors until crossfire is achieved;

c) after crossfire has occurred, gradually decreasing fuel flow to said first injectors and decreasing and terminating fuel flow to said first sector of said aft injector assembly and initiating and increasing fuel flow to said second injectors until the engine reaches a full-speed no-load condition;

d) at engine full-speed no-load condition, fuel flow gradually increases to said first and second injectors to a first part-load;

e) at said first part-load condition, gradually decreasing fuel flow to said first and second injectors while gradually increasing fuel flow to said first sector of said aft injector assembly;

f) as load increases, gradually increasing fuel flow to each of said first and second injectors and said first sector of said aft injector assembly to a second part-load condition;

g) at said second part-load condition, gradually decreasing fuel flow to said first and second injectors and said first sector of said aft injector assembly, while initiating, and gradually increasing fuel flow to a second sector of said aft injector assembly; and, h) as load increases, gradually increasing fuel flow to said first and second injectors and said first and second sectors of said aft injector assembly.

2. The method of claim 1 wherein NOx emissions are controlled as total combustor fuel flow increases by reducing fuel flow to the previously activated injector.

3. The method of claim 1 wherein said gas turbine combustion system further comprises a second swirler adjacent said aft injector assembly.

4. The method of claim 1 wherein said first sector comprises two regions not adjacent to one another.

5. The method of claim 4 wherein said second sector comprises two regions not adjacent to one another.

6. The method of claim 5 wherein said second sector injects a larger amount of fuel than said first sector.

* * * * *